US009956598B2

(12) United States Patent
Vasi

(10) Patent No.: US 9,956,598 B2
(45) Date of Patent: May 1, 2018

(54) LAYING HEAD

(71) Applicant: Danieli & C. Officine Meccaniche S.P.A., Buttrio (IT)

(72) Inventor: Massimo Vasi, Campoformido (IT)

(73) Assignee: Danieli & C. Officine Meccaniche S.P.A., Buttrio (IT)

( * ) Notice: Subject to any disclaimer, the term of this patent is extended or adjusted under 35 U.S.C. 154(b) by 0 days. days.

(21) Appl. No.: 15/380,558

(22) Filed: Dec. 15, 2016

(65) Prior Publication Data

US 2017/0173653 A1 Jun. 22, 2017

(30) Foreign Application Priority Data

Dec. 18, 2015 (IT) ..... 102015000085366

(51) Int. Cl.
*B21C 47/14* (2006.01)

(52) U.S. Cl.
CPC ..... *B21C 47/143* (2013.01); *B21C 47/14* (2013.01)

(58) Field of Classification Search
CPC ..... B65H 51/02; B21C 47/14; B21C 47/143
See application file for complete search history.

(56) References Cited

FOREIGN PATENT DOCUMENTS

| | | | |
|---|---|---|---|
| EP | 0779115 | A1 | 6/1997 |
| WO | WO2006111382 | A2 | 10/2006 |
| WO | WO2006125793 | A1 | 11/2006 |
| WO | WO2012119935 | A1 | 9/2012 |
| WO | WO2014921390 | A1 | 6/2014 |

*Primary Examiner* — William E Dondero
(74) *Attorney, Agent, or Firm* — Stetina Brunda Garred & Brucker

(57) ABSTRACT

A coil-forming head, defining a longitudinal axis, for forming coils of a substantially rectilinear metallic product, comprising a fixed supporting structure, a rotor, adapted to turn about said longitudinal axis and rotatably fixed to said supporting structure, wherein the rotor comprises a bell-shaped member, which expands outwards with respect to said axis and has an outer surface thereof provided with at least one spiral-shaped groove, dimensioned to convey and form coils of a metallic product having diameter from 5 to 8 mm, and comprises at least one spiral-shaped tube, arranged inside and integrally fixed to said bell-shaped member, and dimensioned to convey and form coils of a metallic product having a diameter from 8 to 25 mm, wherein feeding means are provided to feed the product to said at least one groove or to said at least one tube.

5 Claims, 3 Drawing Sheets

LAYING HEAD

CROSS REFERENCE TO RELATED APPLICATION(S)

The present application claims priority to Italian Patent Application No. 102015000085366 filed Dec. 18, 2015, the entirety of the disclosures of which are expressly incorporated herein by reference.

STATEMENT RE: FEDERALLY SPONSORED RESEARCH/DEVELOPMENT

Not Applicable.

FIELD OF THE INVENTION

The present invention relates to a coil-forming laying head for continuous and substantially rectilinear semi-finished products, such as for example wire rods, rods or other, coming from a rolling mill or other similar source.

BACKGROUND ART

A solution commonly used to obtain coils from metallic rods is to use a laying head comprising a rotor in which a rod conveying and coil forming tube is fixed. The rotor is fixed in overhanging manner on a stator body by means of two bearings or supports and may thus turn about its axis. The stator body is in turn rigidly constrained to a base. The rotor turns about its axis generally at high angular speeds, which may exceed 2000 rpm. The rotation of the rotor is be generated by an external motor connected by means of a bevel gear transmission. Laying heads types, in which the rotors comprise the motor therein and coaxially fit the motor stator, are also known.

The rolled product, during the rotation of the laying head, is curved by the tube to form a succession of coils of defined diameter, which are arranged by falling on an evacuation conveyor belt to be cooled and conveyed to the collection and stacking pit.

An alternative solution for obtaining coils from metallic wire rods is to use solutions which provide the elimination of the coil conveying and forming tube. For example, document EP-A-779115 describes a laying head which instead of the coil forming tube uses a spiral shaped conveying groove obtained between two rotating bell-shaped members, an inner one and an outer one, which are mutually integral and fixed by means of a flange to the mandrel. The head is provided with four of more grooves which may be used alternatively for conveying and guiding the rolled product in the laying head.

The two bells are generally made of light materials, such as light alloys or composite materials, which make it possible to reach high rotation speeds. The grooves may be coated with wear-proof material to extend their working life.

In the known systems, two laying heads arranged side-by-side are normally provided, which can be selectively activated with the pass line of the rolled product by means of rails. A first laying head comprises a rotor in which a bell-shaped member is fixed, the bell-shaped member being provided on its outer surface with four or more grooves which can be alternatively used for conveying and guiding the wire rod in the laying head. A second laying head comprises a rotor in which a wire rod conveying and coil forming tube is fixed.

Disadvantageously, when the product type has to be changed, e.g. to pass from rod to wire rod or vice versa, the two laying heads must be moved along the rails, arranged transversally to the pass line of the rolled product, so as to move the first laying head away from said pass line and approach and align the second laying head to said pass line.

This solution, however, implies considerable dimensions of the system and long production change times.

The need is therefore felt to make an innovative laying head which makes it possible to overcome the aforesaid drawbacks.

SUMMARY OF THE INVENTION

It is an object of the present invention to provide a laying head which makes it possible to process different types of metal products, reducing dimensions and also costs of the plant.

It is a further object of the present invention to provide a laying head which makes it possible to considerably reduce the production change times.

The present invention thus reaches the above-described objects by making a laying head, defining a longitudinal axis, which according to claim 1, comprises a fixed supporting structure, a rotor, adapted to turn about said longitudinal axis and rotatably associated to said supporting structure, wherein the rotor comprises

- a bell-shaped member, which expands outwards with respect to said longitudinal axis and has an outer surface thereof provided with at least one spiral-shaped groove, dimensioned to convey and form coils of a metallic product having a first diameter,
- and at least one spiral-shaped tube, arranged inside and integrally fixed to said bell-shaped member, and dimensioned to convey and form coils of a metallic product having a second diameter greater than said first diameter, wherein there are provided feeding means to feed the metallic product to said at least one groove or to said at least one tube.

The laying head, or coil-forming head, of the invention makes it possible to join a grooved bell, suited for winding a wire rod of diameter from 5 mm to 8 mm, and a coil conveying and forming tube for winding wire rods of diameter from 8 to 25 mm, on one machine.

The laying head is formed by a laying bell which is externally provided with spiral-shaped grooves, which allow the creation of wire rod coils by virtue of the rotation of the bell itself. By means of the revolver configuration of the outer surface of the bell, it is possible to prevent the wear of the pass grooves of the material caused by of the high speed and concurrent heat of the material. A specific rotating selector device aligns the selected groove with the through conduit in the selector device itself in order to direct the material correctly into the selected groove. The bell and the selector device turn in mutually integral manner during the formation of the coils. Advantageously, the inner bell periodically turns with respect to the selector device as a function of the local wear which is determined on the groove in use for passing the product to be processed into a new groove.

Advantageously, at least one tube is integrally fixed inside the bell. Said at least one tube is at least partially spiral-shaped, and can create wire rod coils by virtue of the rotation of the bell itself. In this case, the material is directed into the tube by means of a specific selector device, which may be fixed, provided with rectilinear inner conduit.

In an alternative variant, a single selector device is envisaged, provided with an inner conduit for guiding the metallic product and adapted to be inclined and to guide said metallic product to the inlet of a respective groove on the bell-shaped member or to the inlet of the at least one inner laying tube. In an alternative variant, a single selector device is envisaged, provided with at least one inner conduit for guiding the metallic product and adapted to be rotated with respect to the bell, and to guide said metallic product to the inlet of a respective groove on the bell-shaped member or to the inlet of the at least one inner laying tube.

The selector device, which is either interchangeable or inclinable and/or rotatable, is thus the member which makes it possible to activate either one or the other laying path according to the campaign of products to be coiled.

In a variant of the invention, the grooved bell is made in stages, e.g. consists of a plurality of truncated-cone-shaped stages or parts which, by being arranged in succession, form the grooved bell which allow the formation of the coils.

Another interesting aspect of the invention is the possibility of exploiting the variable speed in which the laying head may turn in order to solve the drawbacks deriving from the fact that the laying tube, inside the laying bell, has a smaller coil diameter than that of the tubes of the prior art, which measures approximately 1000 mm instead of 1080 mm, for example. Coils of size equal to those obtained in the prior art can be obtained by varying the speed of the head with respect to that of arrival of the material despite the coil diameter being smaller. It is thus possible to create coils of different size by appropriately varying the rotation speed of the laying head, optimizing the final size of the reel which can be obtained in this manner.

The dependent claims describe preferred embodiments of the invention.

BRIEF DESCRIPTION OF THE FIGURES

Further features and advantages of the present invention will be apparent in light of the detailed description of preferred, but not exclusive, embodiments, of a laying head illustrated by the way of non-limitative example, with reference to the accompanying drawings, in which.

The same reference numbers and letters in the figures refer to the same elements or components.

DETAILED DESCRIPTION OF PREFERRED EMBODIMENTS OF THE INVENTION

Figure 3:
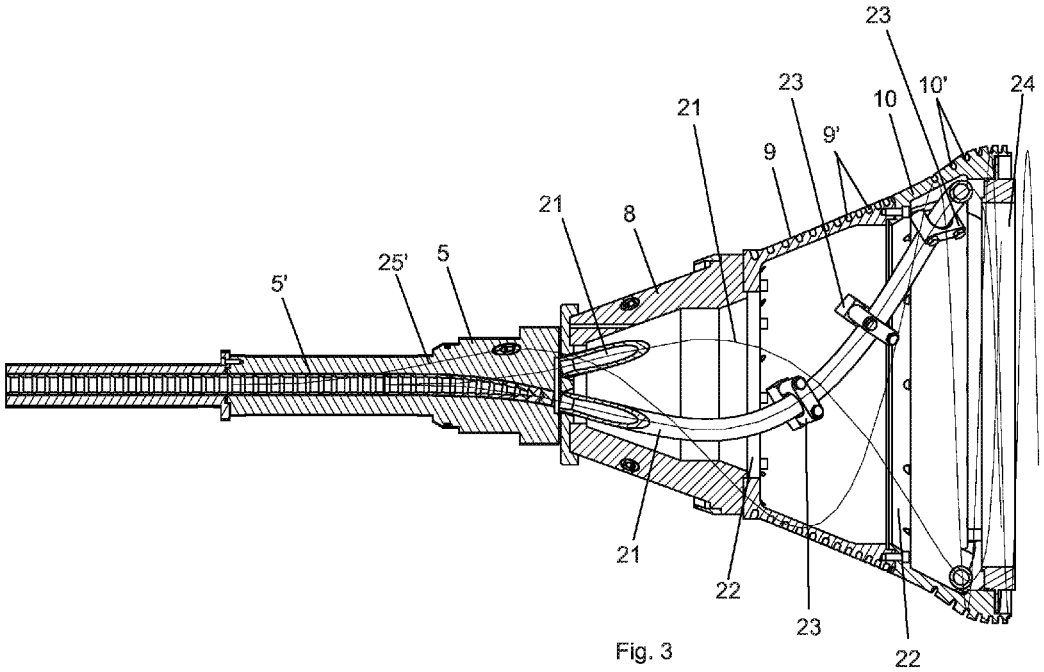
FIG. 3 is a section view of a laying head, along section A-A of FIG. 2.

With reference to the figures, the laying head which is the object of the present invention is shown. In particular, in FIG. 3, the laying head is shown along a section plane A-A passing through longitudinal axis X.

The laying head comprises:

- a fixed supporting structure, for example a basement or a casing,
- and a rotor 1, adapted to turn about said longitudinal axis X and rotatably associated, for example by means of bearings, to said supporting structure.

Figure 1:
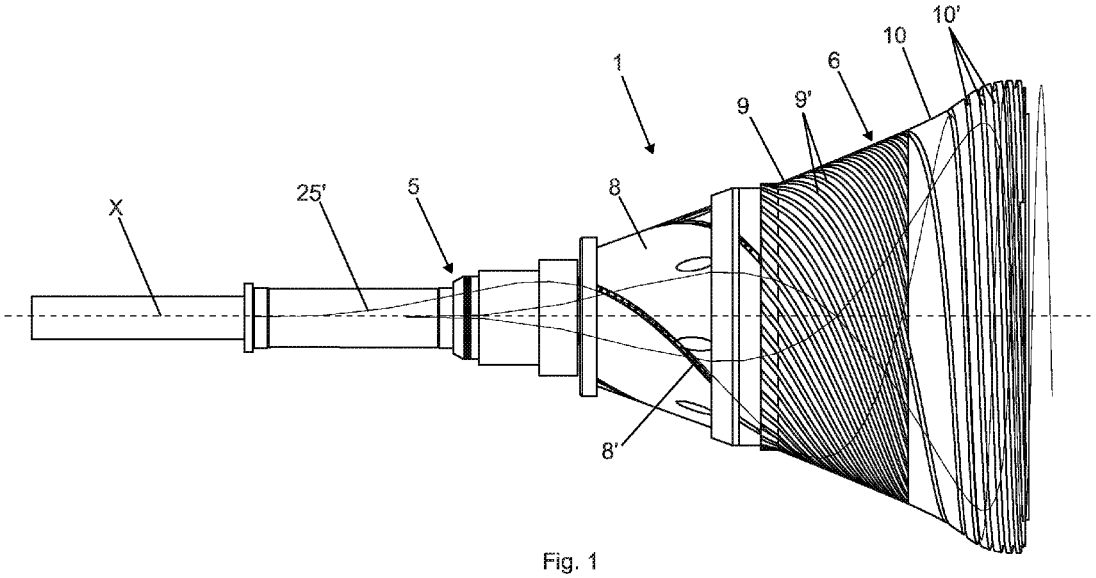
FIG. 1 is a side view of a laying head according to the invention.

The rotor 1 in turn comprises a mandrel and a substantially truncated-cone-shaped bell-shaped member 6, which expands outwards with respect to the longitudinal axis X and axially cooperates with the mandrel. The bell-shaped member 6 is provided with a plurality of substantially spiral-shaped grooves 8', 9', 10' (FIGS. 1 and 3) or channels on its outer surface to guide the metallic product for forming the coils.

The spiral-shaped grooves of the bell-shaped member 6 are advantageously dimensioned to convey and coil a metallic product having a first predetermined diameter, preferably comprised between 5 to 8 mm, e.g. a wire rod. Preferably, the radius of the grooves may vary from 8 to 20 mm.

The bell-shaped member 6 is substantially hollow truncated-cone-shaped and has a substantially cylindrical end stretch. In such an end stretch, the grooves form a single cochlea, the pitch of which is regulated by the number of grooves made on the bell itself.

In particular, the mandrel, preferably shaped as a hollow cylinder, is stably connected by means of mechanical coupling, to the bell-shaped member 6 according to axis X. The bell-shaped member 6 is inserted in the mandrel for an initial stretch and is inserted in a housing, the shape of which mates with that of said bell-shaped member 6. Preferably, the housing is truncated-cone-shaped. The housing is integral with the base or the casing of the laying head and is thus fixed, i.e. not rotatable. A small gap is left between the bell-shaped member 6 and the housing, e.g. at least 1 mm, which is in general sufficient to allow the relative rotation of the bell-shaped member 6 about axis X without causing interference or sliding against the housing. Preferably, such a clearance is smaller than the thickness of the metallic product to be coiled. The mandrel turns in the casing, fixed to the ground. The mandrel is rotationally associated to said casing by means of bearings. The casing may be entirely monolithic with the housing.

According to a preferred variant, the housing may be opened so as to allow access to the bell-shaped member 6.

According to another variant, the housing may be sliding along the axis X with respect to the bell-shaped member 6 to be able to vary the gap between the housing and the bell-shaped member itself.

The function of the housing is to contain the head and the tail of the piece of product to be coiled, which would otherwise tend to be ejected from the laying head by the centrifuge force. Thus, the housing acts as containing and protecting member. The fact of having a rotating bell with grooves open externally towards the housing has the advantage that the tail of the rolled product is braked, by the friction produced by the sliding against the inner surface of the housing, on the entire length of said housing. In this manner, when the tail arrives on the cochlea placed on the end of the bell-shaped member 6, the metallic product does not expand and is not thrown by a whiplash effect, so that perfect coils are obtained without defects. Furthermore, the presence of the housing makes it possible to obtain a better heat distribution of the head in the laying head. Indeed, the housing is uniformly heated on its entire surface by radiation by virtue of the combined action of the rotation of the rotor and the sliding of the rolled metallic product in the groove engaged each time. The bell-shaped member 6, instead, is subject to a non-symmetric heating by conduction of the rolled product which runs in the employed groove, but the radiation of the housing towards the inner bell-shaped member 6 makes it possible to decrease and compensate for such lack of heat uniformity. Furthermore, the reverberated heat of the coils unloaded onto the belt also contributes to a better uniformity of the temperature in the bell-shaped member 6. Thus, the heat deformations are uniformly and symmetrically distributed, with further benefits on the dynamic balancing of the laying head.

Advantageously, the mandrel contains inside feeding means of the metallic product to at least one of the grooves present on the bell-shaped member 6.

The rotor 1 of the laying head of the invention advantageously comprises at least one at least partially spiral-shaped tube 21 in the bell-shaped member 6.

Such tube 21 is integrally fixed to said bell-shaped member 6 and is advantageously dimensioned to convey and coil a metallic product, for example a rod, having a second predetermined diameter, preferably comprised between 8 and 25 mm, greater than said first predetermined diameter. Preferably, the inner diameter of the tube 21 may be comprised between 20 and 50 mm.

Supporting rings 22 are preferably envisaged, fixed to the inner surface of the bell-shaped member 6 and arranged coaxial to the axis X, for fixing the tube 21 to the bell-shaped member itself. The fixing means used to fix the tube 21 to the supporting rings 22, or directly to the inner surface of the bell-shaped member 6, are for example clamps 23. However, other suitable fixing means of the tube may be used.

The bell-shaped member 6 may be formed by two or three stages or parts. The end stage or part 10 comprises a substantially cylindrical end stretch of the bell-shaped member 6 in which a tube end stretch 21 is arranged, provided with the outlet section of the spiral-shaped metallic product. The outlet section of the end stretch of the tube 21 may be in the end stretch of the bell-shaped member 6 or external to said bell-shaped member 6.

The tube 21 has an inlet axis coaxial to the rolling line X and the outlet axis tangent to the nominal theoretical diameter of the coils which are formed in sequence.

A further supporting ring 24 is preferably provided, fixed inside the end opening of the bell-shaped member 6 and arranged coaxial to the axis X. The ring 24 is only used to block the end part of the tube 21 and is shaped to guarantee that the metallic product has an advancement movement.

Figure 2:
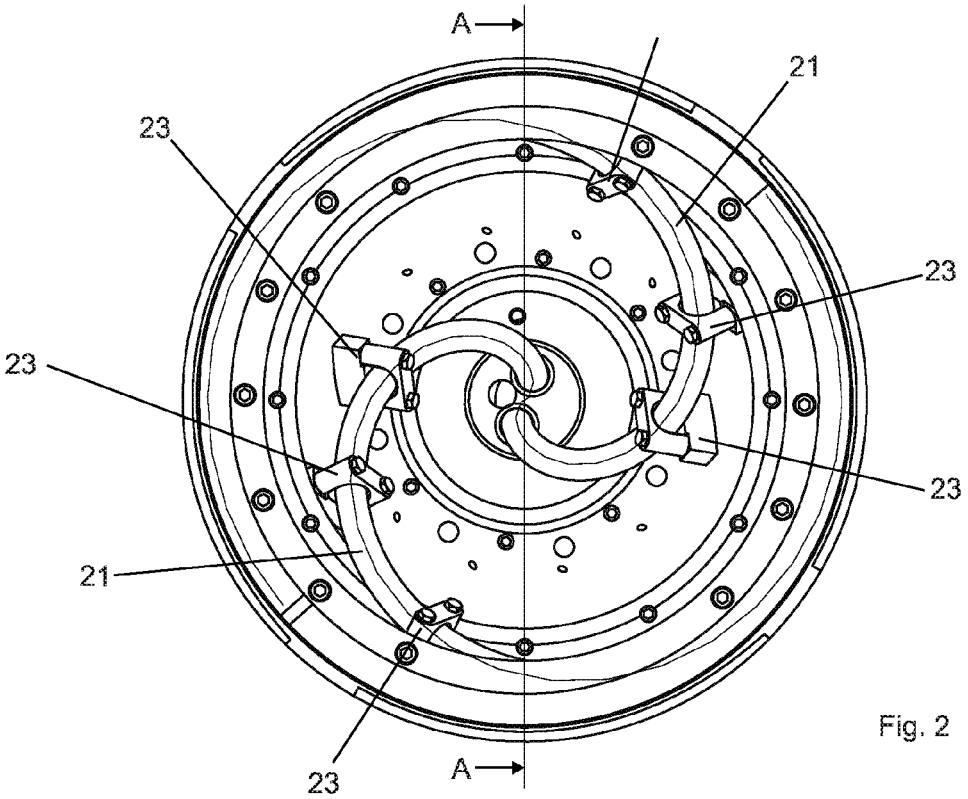
FIG. 2 is a front view of the laying head according to the invention.

A variant of the invention (FIGS. 1-3) envisages a single selector device 5 configured to be rotated about axis X. In particular, the selector device 5 is configured to be rotated with respect to the bell-shaped member 6. In other words there can be a relative rotation of the selector device 5 with the respect to the bell-shaped member 6. The selector device 5 is provided with at least one inner conduit 5' which can communicate with tube 21, and with at least one inner conduit 25' which can communicate with a groove of the bell-shaped member 6. Thereby, the selector device 5 can guide, by means of a respective inner conduit 25', the metallic product to the inlet of a respective groove on the bell-shaped member 6 or can guide, by means of a respective inner conduit 5', the metallic product to the inlet of said tube 21, according to the size of the product to be coiled. Preferably, a stretch of the inner conduit 5', which is distal from the bell-shaped member 6, lies on axis X and a stretch of the inner conduit 5', which is proximal to the bell-shaped member, is inclined with respect to axis X.

A main control is provided connected to the mandrel to feed the bell-shaped member 6 rotatably about axis X, e.g. by means of a reducer or equivalent means. The selector device turns always synchronously with the bell-shaped member 6 and the mandrel during the transit of the rolled product. The selector device may preferably receive the motion of the mandrel itself by means of a differential timing system, for example.

In this variant, two or more tubes 21 are present arranged symmetrically and radially in order to balance the centrifugal forces deriving from the rotation speed of the laying head in order to allow a rapid replacement of the worn tube.

Preferably, the bell-shaped member 6 is made in three substantially truncated-cone-shaped stages 8, 9, 10 arranged joined and mutually in succession along the longitudinal axis X so that their outer surfaces, provided with respective spiral-shaped grooves 8', 9', 10', jointly define the outer surface of the member 6. Furthermore, the greatest common divisor of the group of the number of spiral-shaped grooves of each stage is preferably equal to the number of spiral-shaped grooves 8', defined "first number", of a first end stage 8 of the bell-shaped member 6, proximal to the feeding means 5, i.e. to the selector device 5.

A second end stage 10, distal from said feeding means 5, is provided with a second number of spiral-shaped grooves 10', which is either equal to or multiple of said first number of grooves 8', on an outer surface thereof. Said second end stage 10 of the bell-shaped member 6 has a substantially cylindrical end stretch, in which said second number of spiral-shaped grooves 10' may cover about a round angle, and in which the number of grooves 10' is preferably moderate, e.g. equal to or no more than double the number of grooves 8', because said grooves must preferably have a very small pitch.

As mentioned, one intermediate stage 9 is also envisaged, arranged between said first 8 and second 10 end stages and provided on its outer surface with a respective number of spiral-shaped grooves 9' which is advantageously a multiple of said first number of grooves 8'.

The number of grooves of two adjacent stages may be advantageously different, in particular if it is geometrically feasible to make an adequate number of grooves on the two stages, or may be equally advantageously the same if, for example, the grooves of the two stages are subject to different wear, and thus have different durations, because of their position.

Angular positioning means are provided to adjust the angular position of one stage with respect to the next. In a possible variant, said angular positioning means are preferably at least one connection pin provided in at least one of two adjacent stages forming the bell-shaped member 6. Envisaging the bell-shaped member 6 in stages makes it also possible to facilitate the access to the at least one tube 21 in case of replacement of the tube, for example. According to another variant, such feeding means comprise, for example, a selector device arranged coaxially to the rotor and provided with an inner conduit for guiding the rolled metallic product to the inlet of a respective groove on the bell-shaped member. The inner conduit has an inlet stretch for receiving the metallic product, which enters into the head along the axis X. Such an inner conduit has an outlet stretch which diverges from the axis X to guide the rolled product to the inlet of one of the grooves on the bell-shaped member.

A main control is provided connected to the mandrel to feed the bell-shaped member rotatably about axis X, e.g. by means of a reducer or equivalent means. The selector device turns always synchronously with the bell-shaped member and the mandrel during the transit of the rolled product, so as to guarantee the continuous alignment between the outlet stretch of the inner conduit and one of the grooves on the bell-shaped member. The selector device may preferably receive the motion of the mandrel itself by means of a differential timing system, for example.

Further components and details of the laying head are omitted because they are not essential to illustrate the invention.

The rotor of the laying head of the invention advantageously comprises at least one at least partially spiral-shaped tube in the bell-shaped member.

Such tube is integrally fixed to said bell-shaped member and is advantageously dimensioned to convey and coil a metallic product, for example a rod, having a second predetermined diameter, preferably comprised between 8 and 25 mm, greater than said first predetermined diameter. Preferably, the inner diameter of the tube may be comprised between 20 and 50 mm.

Supporting rings are preferably envisaged, fixed to the inner surface of the bell-shaped member and arranged coaxial to the axis X, for fixing the tube to the bell-shaped member itself. The fixing means used to fix the tube to the supporting rings, or directly to the inner surface of the bell-shaped member, are for example clamps. However, other suitable fixing means of the tube may be used.

In this variant, the bell-shaped member may be formed by two or three stages or parts. The end stage or part comprises a substantially cylindrical end stretch of the bell-shaped member in which a tube end stretch is arranged, provided with the outlet section of the spiral-shaped metallic product. The outlet section of the end stretch of the tube may be in the end stretch of the bell-shaped member or external to said bell-shaped member.

The tube has an inlet axis coaxial to the rolling line X and the outlet axis tangent to the nominal theoretical diameter of the coils which are formed in sequence.

A further supporting ring is provided, fixed inside the end opening of the bell-shaped member and arranged coaxial to the axis X. The ring is only used to block the end part of the tube and is shaped to guarantee that the metallic product has an advancement movement.

In order to direct the metallic product in the tube, the feeding means comprise a further selector device, i.e. a second selector device, provided with a respective inner conduit for guiding the metallic product to the inlet of said tube.

The inner conduit has a rectilinear axis which coincides with the longitudinal axis X when the second selector device is aligned with the rotor. As the rectilinear axis of the inner conduit is in the working position aligned with the inlet of the tube, it may remain fixed and not turn about the axis X in integral manner to the rotor.

The first selector device and the second selector device are arranged alternatively coaxially to the longitudinal axis X. For example, for changing the production of coils from a metallic product with diameter from 5 to 8 mm to a metallic product with diameter from 8 to 25 mm, the first selector device is moved from the axis X and replaced with the second selector device, thus passing from a coiling performed by means of a groove of the bell-shaped member to a coiling by means of the tube in the bell-shaped member.

An advantageous variant of the invention envisages, instead, a single selector device (not shown), configured to be inclined with respect to the axis X and possibly also turned about its axis so as to guide, by means of a respective inner conduit, the metallic product to the inlet of a respective groove on the bell-shaped member or to the inlet of said tube, according to the size of the product to be coiled.

Variants of the invention (not shown) may be envisaged, in which two or more tubes are present arranged symmetrically and radially in order to balance the centrifugal forces deriving from the rotation speed of the laying head in order to allow a rapid replacement of the worn tube. The working tube change operation is carried out by means of a selector device arranged upstream of the radial arrangement which performs the function of leading in the metallic product and conveying it to one of the laying tubes of the radial arrangement. Such selector device has an inner conduit having an inlet stretch for receiving the metallic product which enters into the head in the coaxial direction of axis X. Such inner conduit has an outlet stretch which diverges from the axis X to guide the rolled product from the inlet direction in one of the shaped tubes.

In a further variant of the invention, the bell-shaped member is advantageously made in at least three substantially truncated-cone-shaped stages arranged joined and mutually in succession along the longitudinal axis X so that their outer surfaces, provided with spiral-shaped grooves, jointly define the outer surface of the member. Furthermore, the greatest common divisor of the group of the number of spiral-shaped grooves of each stage is advantageously equal to the number of spiral-shaped grooves, defined "first number", of a first end stage of the bell-shaped member, proximal to the feeding means.

A second end stage, distal from said feeding means, is provided with a second number of spiral-shaped grooves, which is either equal to or multiple of said first number of grooves, on an outer surface thereof. Said second end stage of the bell-shaped member has a substantially cylindrical end stretch, in which said second number of spiral-shaped grooves may cover about a round angle, and in which the number of grooves is preferably moderate, e.g. equal to or no more than double the number of grooves, because said grooves must preferably have a very small pitch.

At least one intermediate stage is also envisaged, arranged between said first and second end stages and provided on its outer surface with a respective number of spiral-shaped grooves which is advantageously a multiple of said first number of grooves. By way of example, three intermediate stages are envisaged, provided with the respective grooves.

The number of grooves of two adjacent stages may be advantageously different, in particular if it is geometrically feasible to make an adequate number of grooves on the two stages, or may be equally advantageously the same if, for example, the grooves of the two stages are subject to different wear, and thus have different durations, because of their position.

Angular positioning means are envisaged to adjust the angular position of one stage with respect to the next. In a possible variant, said angular positioning means are at least one connection pin envisaged in at least one of two adjacent stages forming the bell-shaped member. Envisaging the bell-shaped member in stages makes it also possible to facilitate the access to the tube in case of replacement of the tube, for example.

The elements and features illustrated in the various embodiments may be combined without because of this departing from the scope of protection of the invention.

The invention claimed is:

1. A coil-forming head, defining a longitudinal axis X, for forming coils of a substantially rectilinear metallic product, comprising a fixed supporting structure, a rotor, adapted to turn about said longitudinal axis X and rotatably associated to said supporting structure, wherein the rotor comprises a bell-shaped member, which expands outwards with respect to said longitudinal axis X and has an outer surface thereof provided with at least one spiral-shaped groove, dimensioned to convey and form coils of a metallic product having a first diameter, and at least one spiral-shaped tube, arranged inside and integrally fixed to said bell-shaped member, and dimensioned to convey and form coils of a metallic product having a second diameter greater than said first diameter, wherein there are provided feeding means to feed the metallic product to said at least one groove or to said at least one tube.

2. A coil-forming head according to claim 1, wherein said feeding means comprise a single selector device, provided with at least one first inner conduit for guiding the metallic product to the inlet of said at least one spiral-shaped tube, and, with at least one second conduit for guiding said metallic product to the inlet of a respective spiral-shaped groove on the bell-shaped member, said single selector device being adapted to be rotated with respect to the bell-shaped member to guide said metallic product to the inlet of a respective spiral-shaped groove on the bell-shaped member or to the inlet of said at least one tube.

3. A coil-forming head according to claim 1, wherein the bell-shaped member coaxially cooperates with a mandrel adapted to contain said feeding means within it.

4. A coil-forming head according to claim 1, wherein said bell-shaped member is substantially hollow truncated-cone-shaped and provided with a substantially cylindrical end stretch within which an end stretch of said spiral-shaped tube is arranged.

5. A coil-forming head according to claim 1, wherein said bell-shaped member is made of at least two stages arranged mutually in sequence along the longitudinal axis X so that outer surfaces of said stages, provided with spiral-shaped grooves, jointly define the outer surface of the bell-shaped member and can be arranged, by turning at least one stage about said longitudinal axis X, in at least one respectively relative angular position so as to define at least one continuous spiral-shaped path for said metallic product along the entire outer surface of the bell-shaped member.

* * * * *